US010213635B2

(12) United States Patent
Baxendell et al.

(10) Patent No.: US 10,213,635 B2
(45) Date of Patent: Feb. 26, 2019

(54) BRACKET INTERLOCK SYSTEMS

(71) Applicant: Kidde Technologies, Inc., Wilson, NC (US)

(72) Inventors: Doug John Baxendell, Clayton, NC (US); David William Frasure, Wilson, NC (US)

(73) Assignee: Kidde Technologies, Inc., Wilson, NC (US)

( * ) Notice: Subject to any disclaimer, the term of this patent is extended or adjusted under 35 U.S.C. 154(b) by 0 days.

(21) Appl. No.: 15/273,001

(22) Filed: Sep. 22, 2016

(65) Prior Publication Data

US 2018/0078803 A1 Mar. 22, 2018

(51) Int. Cl.

| | |
|---|---|
| ***A62C 13/64*** | (2006.01) |
| ***F17C 13/08*** | (2006.01) |
| ***A62C 13/78*** | (2006.01) |
| ***A62C 3/07*** | (2006.01) |
| ***A62C 13/76*** | (2006.01) |
| ***A62C 35/68*** | (2006.01) |
| *A62C 13/00* | (2006.01) |

(52) U.S. Cl.

CPC ..... *A62C 13/64* (2013.01); *A62C 3/07* (2013.01); *A62C 13/76* (2013.01); *A62C 13/78* (2013.01); *A62C 35/68* (2013.01); *F17C 13/084* (2013.01); *A62C 13/003* (2013.01); *F17C 2205/0103* (2013.01); *F17C 2205/0173* (2013.01); *F17C 2270/0754* (2013.01)

(58) Field of Classification Search

CPC ..... A62C 13/64; A62C 35/68; A62C 13/76; A62C 3/07; A62C 13/78; F17C 13/084; F17C 13/003; F17C 2205/0173; F17C 2205/0103; F17C 2270/0754

USPC ..... 222/402.11

See application file for complete search history.

(56) References Cited

U.S. PATENT DOCUMENTS

| | | | | |
|---|---|---|---|---|
| 2,017,319 | A * | 10/1935 | McMullen | A62C 13/78 222/175 |
| 2,910,262 | A * | 10/1959 | Haessler | A62C 13/78 248/304 |
| 4,363,424 | A | 12/1982 | Holben et al. | |
| 8,499,845 | B2 | 8/2013 | Luders et al. | |
| 2012/0073839 | A1 * | 3/2012 | Thomas, III | A62C 13/76 169/30 |

(Continued)

FOREIGN PATENT DOCUMENTS

| | | |
|---|---|---|
| CN | 204141032 U | 2/2015 |

OTHER PUBLICATIONS

European Extended Search Report, of the European Patent Office, dated Feb. 9, 2018, issued in corresponding European Patent Application No. 17191945.9.

*Primary Examiner* — Donnell Long

(74) *Attorney, Agent, or Firm* — Locke Lord LLP; Scott D. Wofsy; Joshua L. Jones

(57) ABSTRACT

A method of operating safety mechanism includes extending a safety pin to block a poppet from opening a flow path from a pressure vessel in the event of the pressure vessel being unmounted from a bracket or in the event of the bracket being unmounted from a support structure. The method includes retracting the safety pin to allow free movement of the poppet for opening the flow path only in the event of the pressure vessel being mounted to the bracket and the bracket being mounted to a support structure.

9 Claims, 5 Drawing Sheets

(56) References Cited

U.S. PATENT DOCUMENTS

| | | | | |
|---|---|---|---|---|
| 2013/0025705 | A1* | 1/2013 | Robinson | F16K 35/022<br>137/315.27 |
| 2015/0041158 | A1 | 2/2015 | Stumm et al. | |

* cited by examiner

BRACKET INTERLOCK SYSTEMS

BACKGROUND OF THE INVENTION

1. Field of the Invention

The present disclosure relates to fire extinguishers, and more particularly to safety mechanisms for reducing the risk of unsafe discharge or fire extinguishers.

2. Description of Related Art

Various fire extinguishers contain highly pressurized gas within a pressure vessel. When properly installed, for example, in a vehicle, the pressurized gas can be discharged to mitigate fires, explosions, or the like. Untimely discharge of the pressurized gas, e.g., when the pressure vessel is not properly secured to a firm structure, can cause the pressure vessel to be propelled in an erratic motion. Safety mechanism can be used to prevent unwanted discharge of the pressurized gas.

The conventional techniques have been considered satisfactory for their intended purpose. However, there is an ever present need for improved safety mechanisms. This disclosure provides a solution for this problem.

SUMMARY OF THE INVENTION

A safety system for a pressure vessel includes a poppet housing with a poppet slidingly mounted therein. The poppet is configured to open a flow path through the poppet housing in a first poppet position, and to open a flow path through the poppet housing in a second poppet position. A safety pin is slidingly mounted in the poppet housing. The safety pin is configured to block movement of the poppet in an extended position, and to allow full movement of the poppet in a retracted position. An actuation lever is operatively connected to actuate the safety pin between the extended and retracted positions. A bracket is operatively connected to the poppet housing and is configured for mounting to a support structure. The bracket includes a safety mechanism configured to force the actuation lever to maintain the safety pin in the extended position with the bracket mounted to a support structure, and to release the actuation lever to allow the safety pin to move to the retracted position with the bracket mounted to a support structure.

The safety mechanism can include a yoke slidingly engaged to the bracket for movement between a first position forcing the actuation lever to maintain the safety pin in the extended position, and a second position to allow the safety pin to move to the retracted position. The safety mechanism can include one or more positioning pins mounted to the yoke and extending through the bracket for moving the yoke to the first position with the bracket mounted to a support structure. The yoke can include a collar configured to seat a neck of a pressure vessel therein. The collar can include fingers biased inward to squeeze the neck of a pressure vessel in the collar. The yoke can include at least one biasing member configured to bias the yoke to the first position forcing the actuation lever to maintain the safety pin in the extended position. The yoke can be mounted within the bracket by two bracket pins passing through respective slots through the yoke.

A pressure vessel can be mounted to the poppet housing so that the poppet regulates flow from the pressure vessel. The safety pin can be mounted to the poppet housing within a bushing. A biasing member can bias the safety pin against the poppet housing towards the extended position. A switch can be operatively connected to the poppet housing to selectively open and close an electrical circuit based on whether the safety pin is in the extended position or the retracted position.

A method of operating safety mechanism includes extending a safety pin to block a poppet from opening a flow path from a pressure vessel in the event of the pressure vessel being unmounted from a bracket or in the event of the bracket being unmounted from a support structure. The method includes retracting the safety pin to allow free movement of the poppet for opening the flow path only in the event of the pressure vessel being mounted to the bracket and the bracket being mounted to a support structure.

Mounting the bracket to a support structure can include mounting the bracket to a vehicle. Mounting the bracket to a support structure can include depressing a positioning pin while mounting the bracket to the support structure to retract the safety pin. The method can include discharging the pressure vessel slowly through an audible leak path past the poppet with the safety pin extended.

These and other features of the systems and methods of the subject disclosure will become more readily apparent to those skilled in the art from the following detailed description of the preferred embodiments taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, preferred embodiments thereof will be described in detail herein below with reference to certain figures, wherein.

DETAILED DESCRIPTION OF THE PREFERRED EMBODIMENTS

Figure 1:
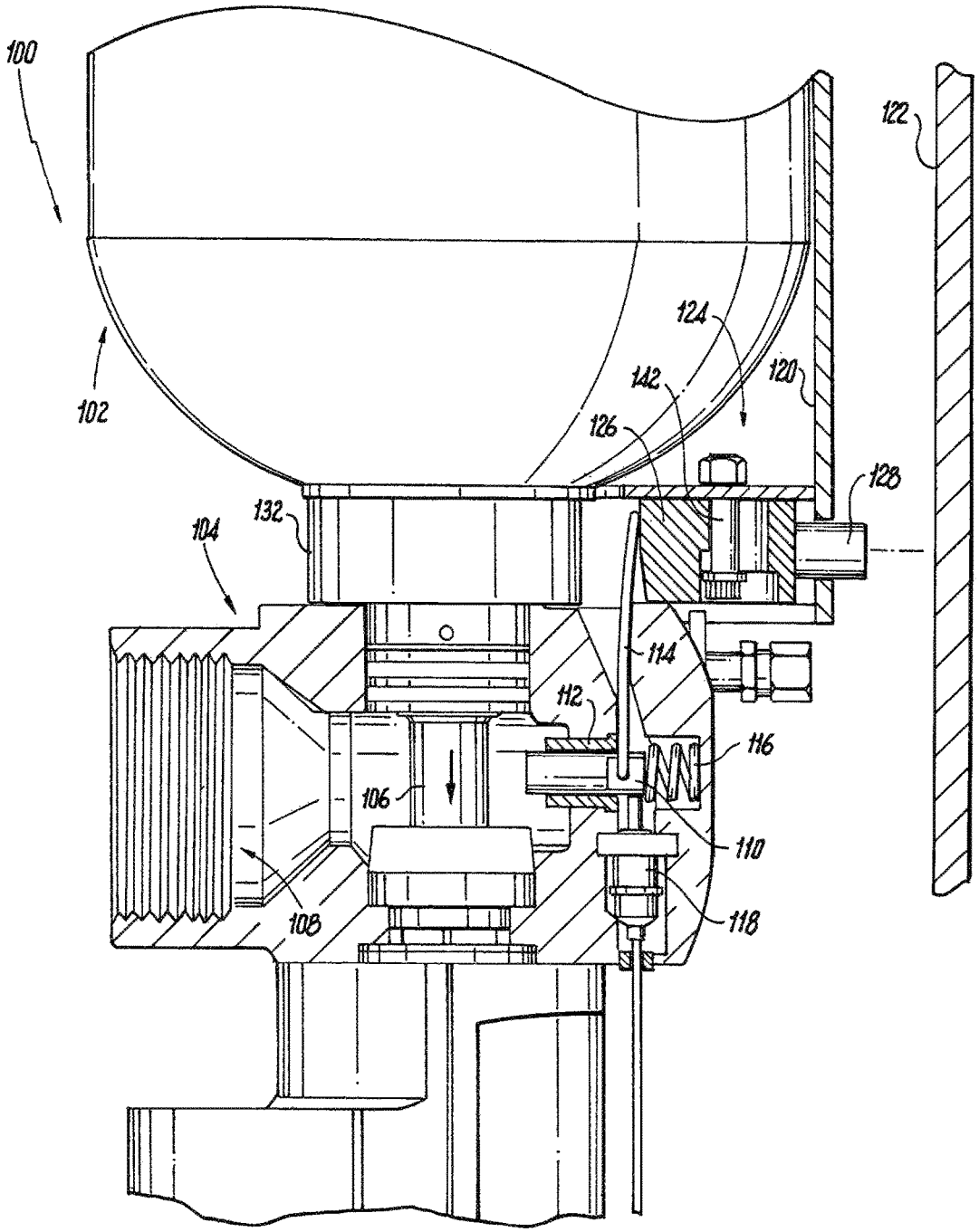
FIG. 1 is a cross-sectional side elevation view of an exemplary embodiment of a safety system constructed in accordance with the present disclosure, showing the safety pin in the extended position to prevent full opening of the poppet.

Reference will now be made to the drawings wherein like reference numerals identify similar structural features or aspects of the subject disclosure. For purposes of explanation and illustration, and not limitation, a partial view of an exemplary embodiment of a safety system in accordance with the disclosure is shown in FIG. 1 and is designated generally by reference character 100. Other embodiments of systems in accordance with the disclosure, or aspects thereof, are provided in FIGS. 2-5, as will be described. The systems and methods described herein can be used to prevent unwanted discharge of a pressurized vessel, such as a high-pressure fire extinguisher tank, even if the mounting bracket thereof is removed from a support structure with the pressure vessel still mounted in the mounting bracket.

Safety system 100 for a pressure vessel 102 includes a poppet housing 104 with a poppet 106 slidingly mounted therein. The poppet 106 is configured to close a flow path 108 from the pressure vessel 102 through the poppet housing 104 in a first poppet position, as shown in FIG. 1, and to open the flow path 108 through the poppet housing 104 in a second poppet position, wherein the movement direction from the first position to the second position is indicated by the large arrows in FIGS. 1 and 3. The pressure vessel 102 is mounted to the poppet housing 104, e.g., by threading as shown in FIG. 1, so that the poppet 106 regulates flow from the pressure vessel 102.

A safety pin 110 is slidingly mounted in the poppet housing 104, e.g., within a bushing 112. The safety pin 110 is configured to block movement of the poppet 106 in an extended position, shown in FIG. 1, and to allow full movement of the poppet 106 in a retracted position shown in FIG. 3, where safety pin 110 is completely clear of the vertical path of the poppet 106. An actuation lever 114 is operatively connected to actuate the safety pin 110 between the extended and retracted positions. A biasing member 116 e.g., a helical compression spring, biases the safety pin 110 against the poppet housing 104 towards the extended position. A switch 118 is operatively connected to the poppet housing 104 to selectively open and close an electrical circuit, e.g., for an indicator light or the like, based on whether the safety pin 110 is in the extended position or the retracted position.

A bracket 120 is operatively connected to the poppet housing 104 and is configured for mounting the pressure vessel 102 and the poppet housing 104 to a support structure 122, such as an internal structural member of a vehicle or building where system 100 is deployed for use. The bracket 120 includes the safety mechanism 124 configured to force the actuation lever 114 to maintain the safety pin 110 in the extended position when the bracket 120 is not mounted to the support structure 122 as shown in FIG. 1, and to release the actuation lever 114 to allow the safety pin 110 to move to the retracted position when the bracket 120 is mounted to the support structure 122 as shown in FIG. 3.

Figure 2:
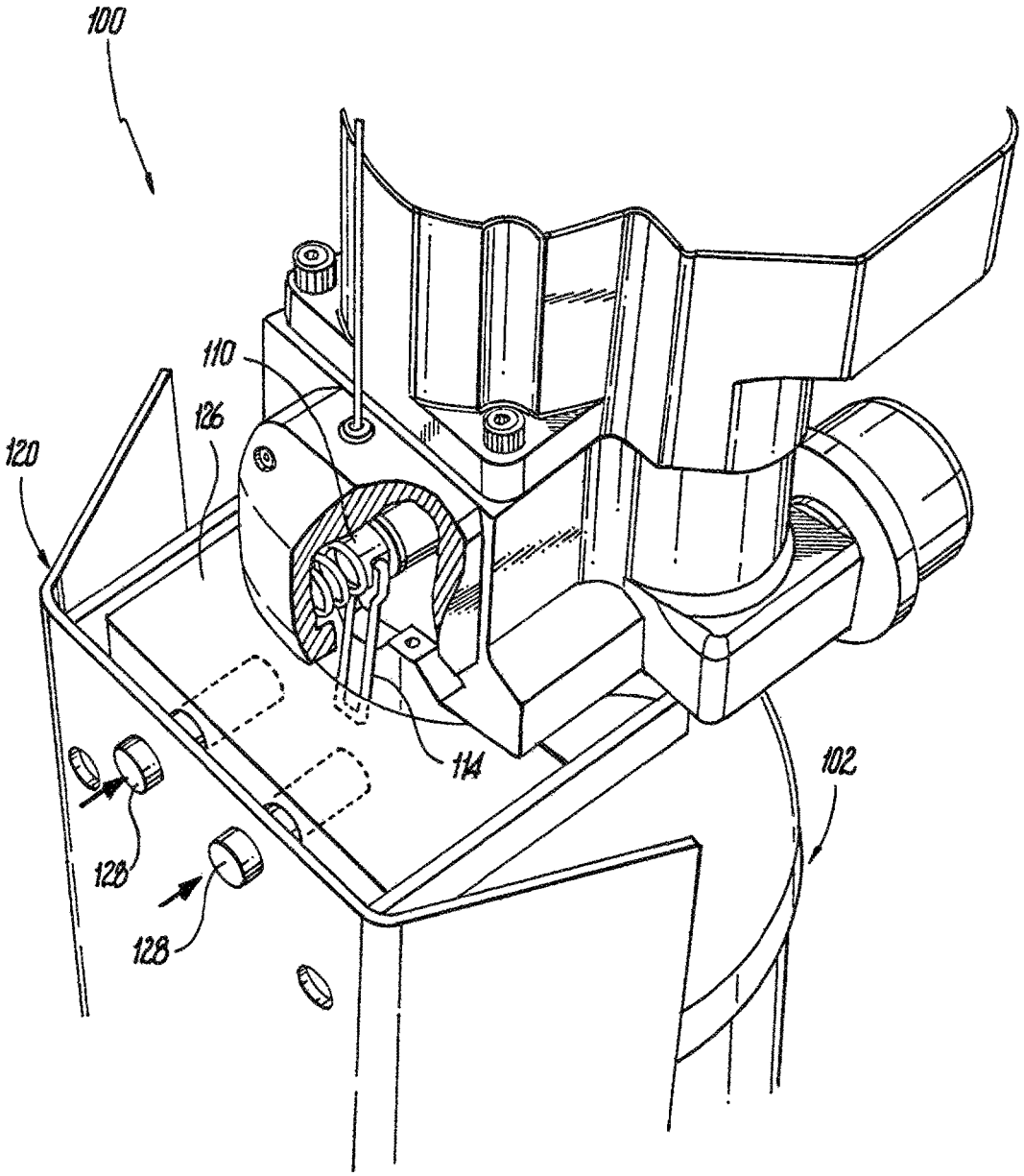
FIG. 2 is a schematic perspective view of the system of FIG. 1, showing the positioning pins extending through the bracket with the safety pin in the extended position.
Figure 3:
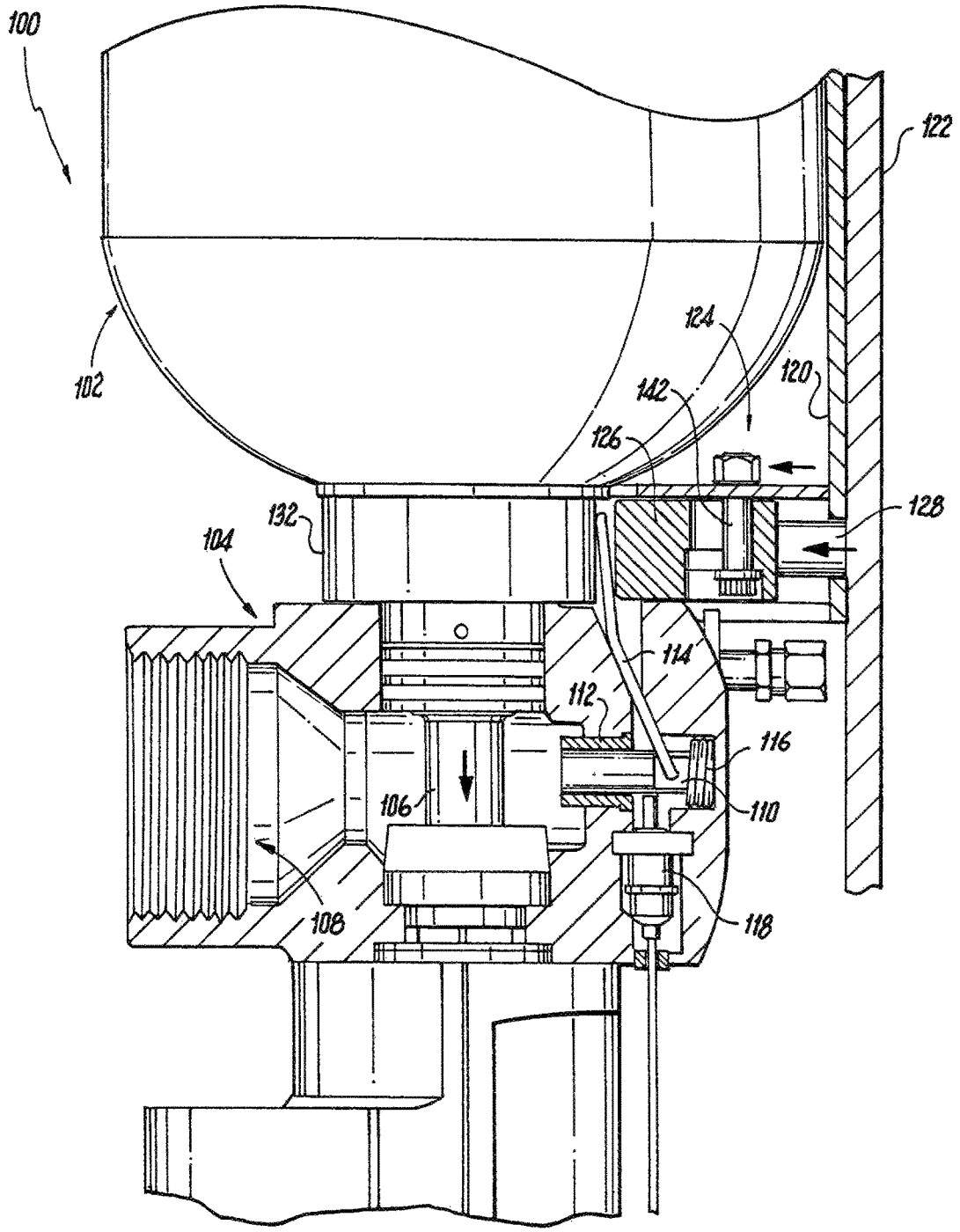
FIG. 3 is a cross-sectional side elevation view of an the safety system of FIG. 1, showing the safety pin in the retracted position with the bracket mounted to a support structure such as in a vehicle.
Figure 4:
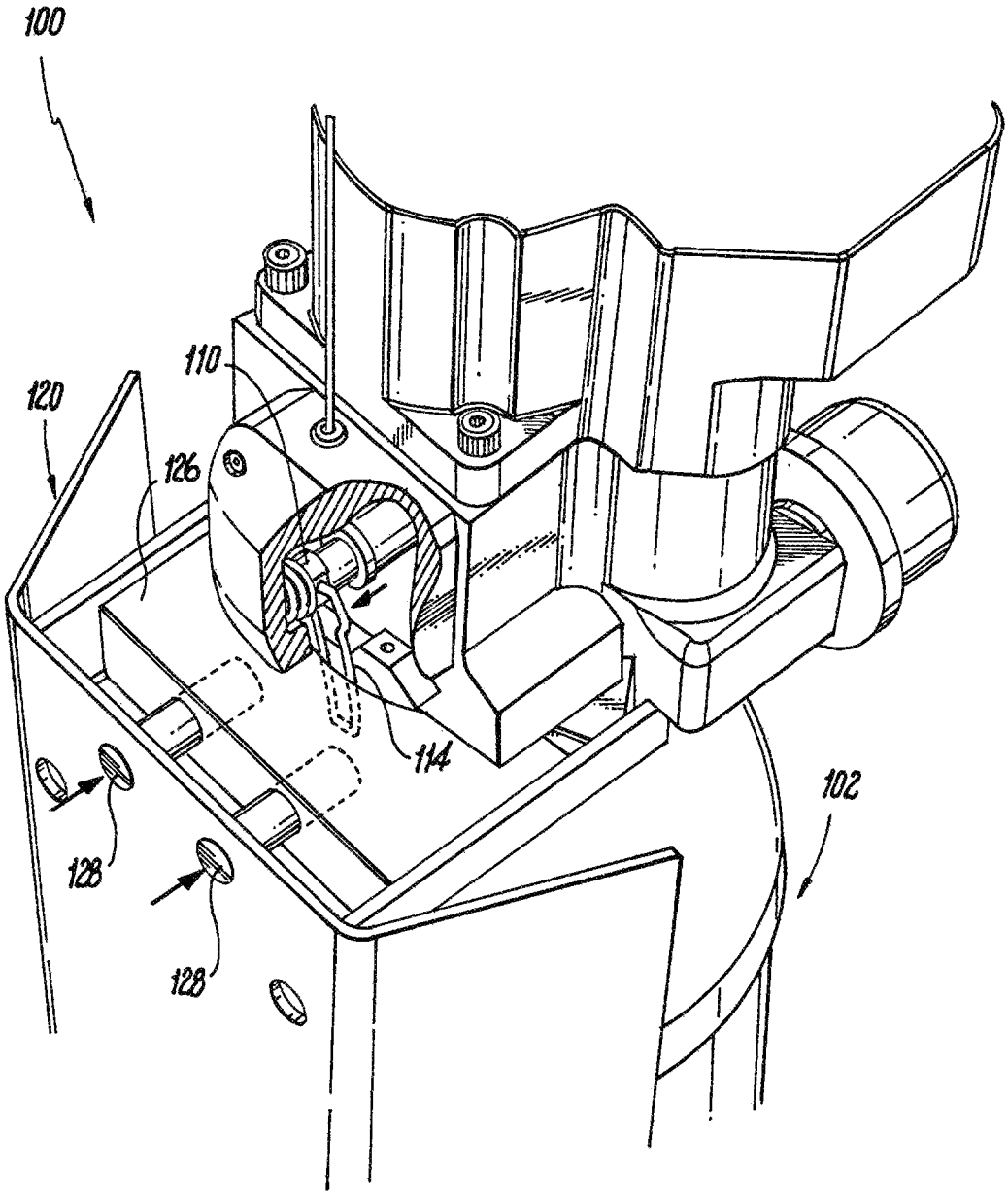
FIG. 4 is a schematic perspective view of the system of FIG. 1, showing the positioning pins pressed inward flush with the bracket as when mounted to a support structure as shown in FIG. 3.

The safety mechanism 124 includes a yoke 126 slidingly engaged to the bracket 120 for movement between a first position forcing the actuation lever 114 to maintain the safety pin 110 in the extended position as shown in FIG. 1, and a second position shown in FIG. 3 to allow the safety pin 110 to move to the retracted position. The safety mechanism 124 includes two positioning pins 128 mounted to the yoke 126 and extending through the bracket 120 for moving the yoke 226 to the first position with the bracket 120 mounted to a support structure 122. Those skilled in the art will readily appreciate that any suitable number of positioning pins 128 can be used, including one or more depending on the size/mass of the figure extinguisher wherein more pins are used the larger the figure extinguisher is, without departing from the scope of this disclosure. FIG. 2 shows positioning pins 128 extending through bracket 120 as in FIG. 1 to prevent full movement of the poppet 106. FIG. 3 shows positioning pins 128 pushed in flush with the bracket 120 as in FIG. 3 to allow full movement of the poppet. The large arrows in FIGS. 2 and 4 indicate the pressing of support structure 122 on positioning pins 128.

Figure 5:
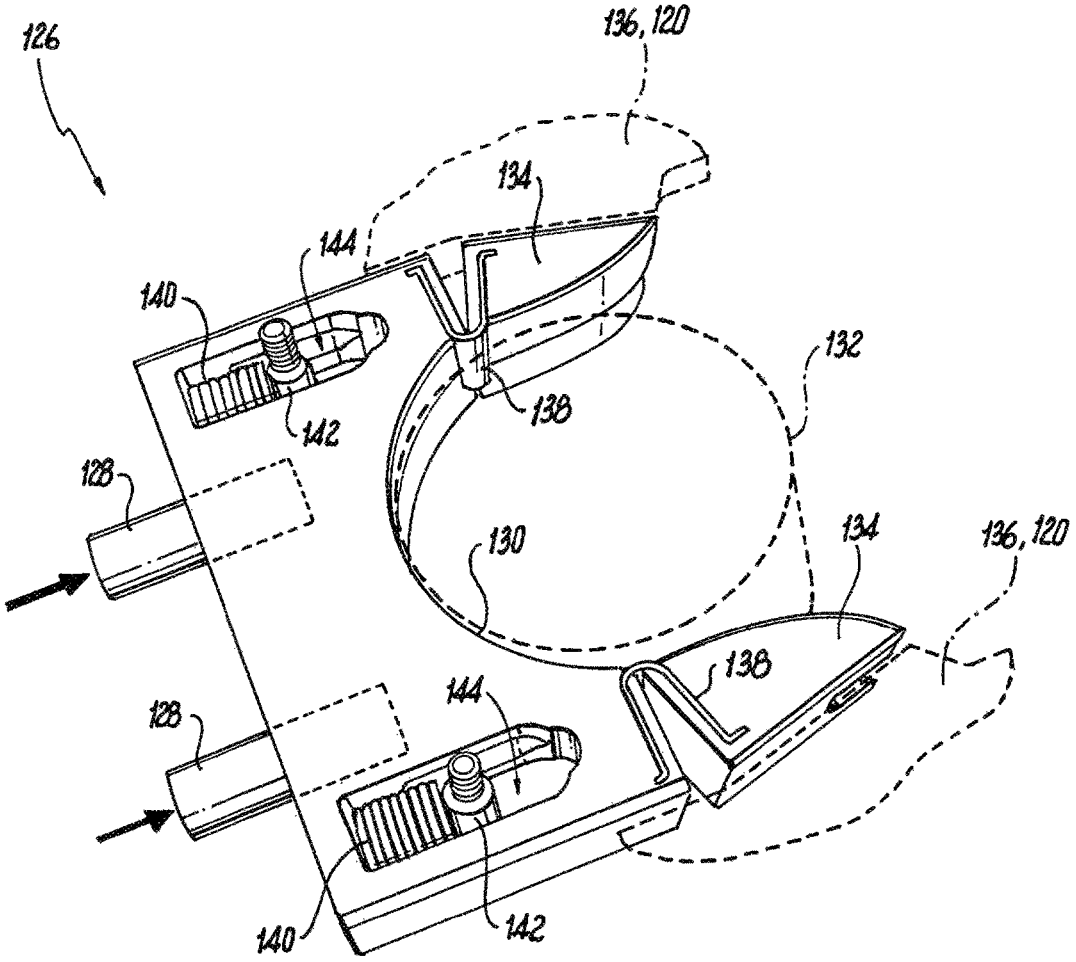
FIG. 5 is a perspective view of a portion of the system of FIG. 1, showing the yoke flexible fingers flexed inward.

With reference now to FIG. 5, the yoke 126 includes a collar 130 configured to seat a neck 132 of the pressure vessel 132 therein. The collar 130 includes fingers 134 urged inward by bumpers 136 defined in bracket 120 to squeeze the neck 132 of the pressure vessel 120 in the collar 130. Springs 138 in fingers 134 bias fingers 134 outward when fingers 134 are clear of bumpers 136. In FIG. 5, neck 132 and bumpers 136 are indicated schematically. The yoke 126 includes are pair of biasing members, e.g., helical compression springs 140 configured to bias the yoke 126 to the first position forcing the actuation lever 114 to maintain the safety pin 110 in the extended position as shown in FIG. 1. The yoke 126 is mounted within the bracket 120 by two bracket pins 142 passing through respective slots 144 through the yoke 126. Springs 140 are compressed between yoke 126 and pins 142. Yoke 126 allows tolerance for some misalignment when mounting pressure vessel 102 and poppet housing 104 in bracket 120, and allows some freedom of rotation for pressure vessel 102 during installation into bracket 102.

A method of operating a safety mechanism, e.g., safety mechanism 124, includes extending a safety pin, e.g., safety pin 110, to block a poppet, e.g., poppet 106, from opening a flow path, e.g., flow path 108, from a pressure vessel, e.g., pressure vessel 102, in the event of the pressure vessel being unmounted from a bracket, e.g., bracket 120, or in the event of the bracket being unmounted from a support structure, e.g., support structure 122. The method includes retracting the safety pin to allow free movement of the poppet for opening the flow path only in the event of the pressure vessel being mounted to the bracket and the bracket being mounted to a support structure.

Mounting the bracket to a support structure can include mounting the bracket to a vehicle or building. Mounting the bracket to a support structure can include depressing a positioning pin, e.g., positioning pin 128, while mounting the bracket to the support structure to retract the safety pin. The method can include discharging the pressure vessel slowly through an audible leak path past the poppet with the safety pin extended. While shown and described in the exemplary context of fire extinguishers, those skilled in the art will readily appreciate that systems and methods as disclosed herein can readily be applied to any suitable pressure vessel without departing from the scope of this disclosure.

The methods and systems of the present disclosure, as described above and shown in the drawings, provide for safety systems and methods with superior properties including prevention of unwanted discharge of a pressurized vessel, such as a high-pressure fire extinguisher tank, even if the mounting bracket thereof is removed from a support structure with the pressure vessel still mounted in the mounting bracket. While the apparatus and methods of the subject disclosure have been shown and described with reference to preferred embodiments, those skilled in the art will readily appreciate that changes and/or modifications may be made thereto without departing from the scope of the subject disclosure.

What is claimed is:

1. A safety system for a pressure vessel comprising:

a poppet housing with a poppet slidingly mounted therein, wherein the poppet is configured to close a flow path through the poppet housing in a first poppet position, and to open a flow path through the poppet housing in a second poppet position;

a safety pin slidingly mounted in the poppet housing, wherein the safety pin is configured to block movement of the poppet in an extended position, and to allow full movement of the poppet in a retracted position;

an actuation lever operatively connected to actuate the safety pin between the extended and retracted positions; and a bracket operatively connected to the poppet housing and configured for mounting to a support structure, wherein the bracket includes a safety mechanism configured to force the actuation lever to maintain the safety pin in the extended position with the bracket not mounted to a support structure, and to release the actuation lever to allow the safety pin to move to the retracted position with the bracket mounted to a support structure, wherein the safety mechanism includes a yoke slidingly engaged to the bracket for movement between a first position forcing the actuation lever to maintain the safety pin in the extended position, and a second position to allow the safety pin to move to the retracted position, wherein the safety mechanism includes one or more positioning pins mounted to the yoke and extending through the bracket with the yoke in the first position if the bracket is not mounted to a support structure and for being pushed in toward the bracket, moving the yoke to the second position with the bracket mounted to a support structure.

2. A system as recited in claim 1, wherein the yoke includes at least one biasing member configured to bias the yoke to the first position forcing the actuation lever to maintain the safety pin in the extended position.

3. A system as recited in claim 1, wherein the yoke is mounted within the bracket by two bracket pins passing through respective slots through the yoke.

4. A system as recited in claim 1, further comprising a pressure vessel mounted to the poppet housing so that the poppet regulates flow from the pressure vessel.

5. A system as recited in claim 1, wherein the safety pin is mounted to the poppet housing within a bushing.

6. A system as recited in claim 1, wherein a biasing member biases the safety pin against the poppet housing towards the extended position.

7. A system as recited in claim 1, further comprising a switch operatively connected to the poppet housing to selectively open and close an electrical circuit based on whether the safety pin is in the extended position or the retracted position.

8. A safety system for a pressure vessel comprising:

a poppet housing with a poppet slidingly mounted therein, wherein the poppet is configured to close a flow path through the poppet housing in a first poppet position, and to open a flow path through the poppet housing in a second poppet position;

a safety pin slidingly mounted in the poppet housing, wherein the safety pin is configured to block movement of the poppet in an extended position, and to allow full movement of the poppet in a retracted position;

an actuation lever operatively connected to actuate the safety pin between the extended and retracted positions; and a bracket operatively connected to the poppet housing and configured for mounting to a support structure, wherein the bracket includes a safety mechanism configured to force the actuation lever to maintain the safety pin in the extended position with the bracket not mounted to a support structure, and to release the actuation lever to allow the safety pin to move to the retracted position with the bracket mounted to a support structure, wherein the safety mechanism includes a yoke slidingly engaged to the bracket for movement between a first position forcing the actuation lever to maintain the safety pin in the extended position, and a second position to allow the safety pin to move to the retracted position, wherein the yoke includes a collar configured to seat a neck of a pressure vessel therein.

9. A system as recited in claim 8, wherein the collar includes fingers biased inward to squeeze the neck of a pressure vessel in the collar.

* * * * *